United States Patent [19]

Chabane et al.

[11] Patent Number: 4,753,002

[45] Date of Patent: Jun. 28, 1988

[54] APPARATUS FOR CLOSING A METALLIC SHIELD AROUND A CABLE CORE

[75] Inventors: Mohamed Chabane, Ste. Julie; Robert A. Hebert, Bois des Filion; Serge Nadeau, Ville Emard; Francois P. Boily, Dollard des Ormeaux, all of Canada

[73] Assignee: Northern Telecom Limited, Montreal, Canada

[21] Appl. No.: 936,065

[22] Filed: Dec. 1, 1986

[51] Int. Cl.[4] ..... B21D 49/00; B21D 51/12; H01B 13/22

[52] U.S. Cl. ..... 29/728; 29/828; 72/51

[58] Field of Search ..... 29/828, 728; 72/51, 72/52

[56] References Cited

U.S. PATENT DOCUMENTS

| | | | |
|---|---|---|---|
| 696,865 | 4/1902 | Friel | 29/728 |
| 715,570 | 12/1902 | Friel | 29/728 |
| 2,177,104 | 10/1939 | Gonser | 72/51 X |
| 4,308,662 | 1/1982 | Bohannon, Jr. | 72/51 X |
| 4,377,908 | 3/1983 | Pan | 29/828 |
| 4,404,720 | 9/1983 | Bohannon, Jr. | 29/728 X |
| 4,622,092 | 11/1986 | Bohannon, Jr. et al. | 29/728 X |

*Primary Examiner*—P. W. Echols
*Assistant Examiner*—Taylor J. Ross
*Attorney, Agent, or Firm*—R. J. Austin

[57] ABSTRACT

A metallic strip and a cable core are advanced together along a passline through conventional apparatus for wrapping the strip around the core to provide a partially formed shield around the cable. The shield and core continue along the passline through apparatus according to the invention for closing the shield around the core. This closing apparatus includes a support roller for supporting the shield and core on the passline, shield engaging members resiliently urged against the shield to hold flanking regions of the shield against the core as the shield is closed, and edge region guide means for urging edge regions of the shield in overlapping relationship onto the core. The edge region guide means are radially adjustable relative to the passline to accommodate different cable diameters.

22 Claims, 5 Drawing Sheets

APPARATUS FOR CLOSING A METALLIC SHIELD AROUND A CABLE CORE

This invention relates to apparatus for closing a metallic shield around a cable core.

In many conventional telecommunications cables a metallic shield is wrapped around a cable core. The shield may be made from steel if mechanical protection of the cable core is desired, or may be made from aluminum if electrical protection from lightning surges is desired. Alternatively, concentric steel and aluminum shields may be provided for combined mechanical and electrical protection. The metallic shields may be corrugated, and concentric steel and aluminum shields may be arranged with the corrugations of one shield nested within the corrugations of the other shield.

Known methods and apparatus for wrapping a metallic shield around a cable core are described in:

U.S. Pat. No. 3,785,048 issued to W. E. Petersen on Jan. 15, 1974;

U.S. Pat. No. 4,100,003 issued to K. P. Trusch on Jul. 11, 1978;

U.S. Pat. No. 4,308,662 issued to W. D. Bohannon, Jr. on Jan. 5, 1982;and U.S. Pat. No. 4,377,908 issued to A. Pan on Mar. 29, 1983.

As described in these patents, a metal tape is brought alongside a cable core so that their longitudinal axes are parallel. The cable core and metal tape are passed together along a common passline in a direction parallel to their longitudinal axes through cone or V-belt forming apparatus which bends the metal tape transverse to its longitudinal axis to wrap it around the cable core, thereby forming a metallic shield around the cable core.

Typically, the transverse dimension of the metal tape exceeds the circumference of the cable core, so that longitudinal edge regions of the metallic shield overlap along the cable core. It is desirable to close the metallic shield around the cable core, bringing the overlapping longitudinal edge regions into firm contact with one another to form a seam. If the metallic shield is not properly closed around the cable core, the outer longitudinal edge region of the shield will protrude from the cable core into a cable jacket, which is typically extruded around the metallic shield. The protruding longitudinal edge region may cut through the extruded jacket when the cable is bent during subsequent handling or installation, exposing the cable core to moisture and other contaminants.

U.S. Pat. No 4,100,003 and 4,308,662 describe shield closing tools which bend the radially outer longitudinal edge region of the shield inward into firm contact with the radially inner longitudinal edge region of the shield to close the shield around the cable core. These shield closing tools include a die having a tapered bore which urges the shield radially inward toward the cable core as they are passed together along a passline through the bore, and a channel arranged within the bore to receive the radially outer longitudinal edge region of the shield and bend it inward toward the radially inner longitudinal edge region of the shield as it is advanced along the channel. As disclosed in U.S. Pat. No. 3,785,048 and 4,377,908, one or both of the longitudinal edge regions may be preformed by anedge forming tool located upstream of the shield closing tool. Such preforming is intended to provide better contact of the longitudinal edge regions when the shield is closed.

Known shield closing tools suffer from a number of practical limitations. For example, the shield closing tools disclosed in the above patents cannot be adjusted to accommodate different cable diameters. As a result, separate shield closing tools are required for each cable size manufactured, and the separate shield closing tools most be interchanged each time a different cable size is manufactured.

The present invention seeks to overcome the above limitation.

Accordingly, the present invention provides apparatus for closing a metallic shield around a cable core as they are advanced together along a passline through the apparatus, the shield and core approaching the apparatus with the shield wrapped around the core, a longitudinally extending central region of the shield contacting the core, longitudinal regions of the shield flanking the central region on opposite sides of the core, and longitudinally extending edge regions of the shield overlapping near the core opposite the central region, the apparatus comprising frame means; support means carried by the frame means and having a support surface disposed to one side of the passline for engaging the central region of the shield to support the shield and core on the passline; a plurality of shield engaging members carried by the frame means in two locations angularly spaced around the passline, one location in each direction from the support surface, the shield engaging members being resiliently urged radially inwards toward the passline to engage and urge the flanking regions of the shield in a radially inwards direction towards the passline; edge region guide means for urging the edge regions of the shield in overlapping relationship onto the core, the guide means radially movably mounted to the frame means angularly between the two locations of the shield engaging members, and having a radially inner guide surface extending in the direction of the passline for guiding one edge region onto the core to form a radially inner edge region, and a radially outer guide surface radially overlying and converging towards the radially inner guide surface for guiding the other edge region as a radially outer edge region in overlapping relationship onto the radially inner edge region; and adjustment means operable between the frame means and the guide means for radially moving the guide means to adjust the positions of the radially inner and outer guide surfaces.

The support means and shield engaging members act to center the cable core and shield on the passline, while the edge region guide means is radially adjustable to accommodate different cable diameters.

Preferably, the edge region guide means comprises a first guide part radially adjustably mounted to the frame means and having a radially inner end including a foot bearing the radially inner guide surface; and a second guide part bearing the radially outer guide surface and radially adjustably mounted to the first guide part radially outward of the foot to define a channel between the second guide part and the foot for receiving, guiding and forming the radially outer edge region in overlapping relationship onto the radially inner edge region as the shield is advanced.

The second guide part is radially adjustably mounted to the first guide part to permit adjustment of the channel width to accommodate different shield thicknesses and corrugation depths, and to facilitate initial feeding of the shield through the channel.

Preferably, the second guide part comprises an upstream element and a downstream element defining, respectively, an upstream region and a downstream region of the radially outer guide surface, and means for adjusting the relative radial positions of the upstream and downstream elements.

While relative radial positioning may be achieved for any suitable arrangement of the elements, it is preferred that the upstream element is radially adjustably mounted upon the first guide part and the downstream element is radially adjustably mounted upon the upstream part.

The radially adjustable mounting of the downstream element to the upstream element permits control of the extent to which the radially outer longitudinal edge region of the shield is formed inward as the shield is advanced along the passline through the apparatus. Radial movement of the upstream element may be made to accommodate a shield of any thickness or corrugation depth in an upstream entrance to the channel. The downstream element is then radially movable to control the radial depth of downstream parts of the channel so as to deform the radially outward edge region of the shield precisely as required to provide firm contact with the radially inner edge region of the shield.

Preferably, the radial position of the downstream element is continuously radially variable so as to allow for continuously controllable deformation of the radially outer edge region of the shield. This is conveniently provided by a screw adjustment means between the downstream and upstream elements.

For overall positional control of the guide means, another screw adjustment means is provided between the first guide part and the second guide part.

An embodiment of the invention will now be described, by way of example only, with reference to the accompanying drawings, in which:

FIG. 1 is a side elevational view of apparatus for wrapping a metallic strip around a cable core, including apparatus according to the embodiment of the invention for closing a metallic shield around the cable core;

FIG. 2 a cross-sectional view of a cable core and metallic shield at section line 11—11 in FIG. 1, drawn to a larger scale than FIG. 1;

Figure 5:
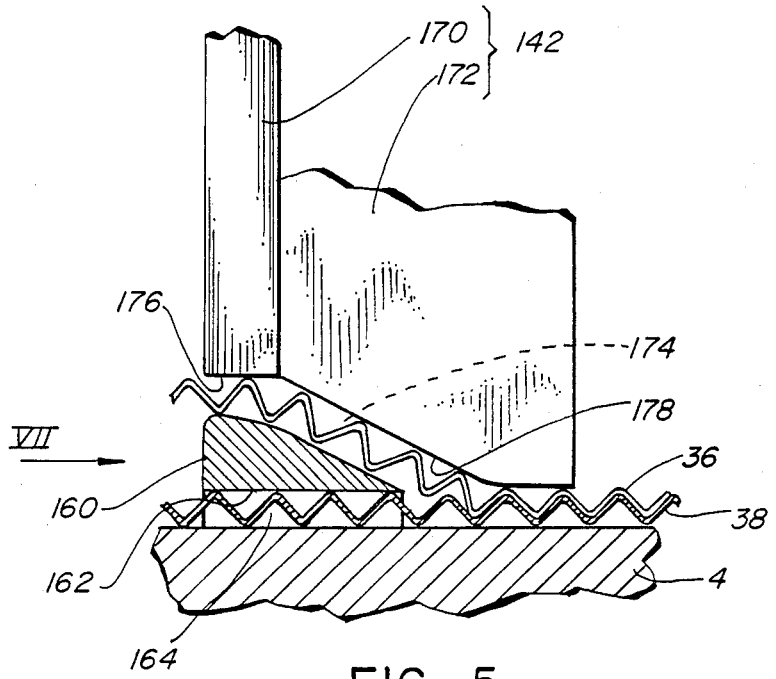
FIG. 5 is a fragmentary side elevational view of guide parts of the apparatus of the embodiment, taken along section line V—V in FIG. 3 and drawn to a larger scale than FIG. 3.
Figure 6:
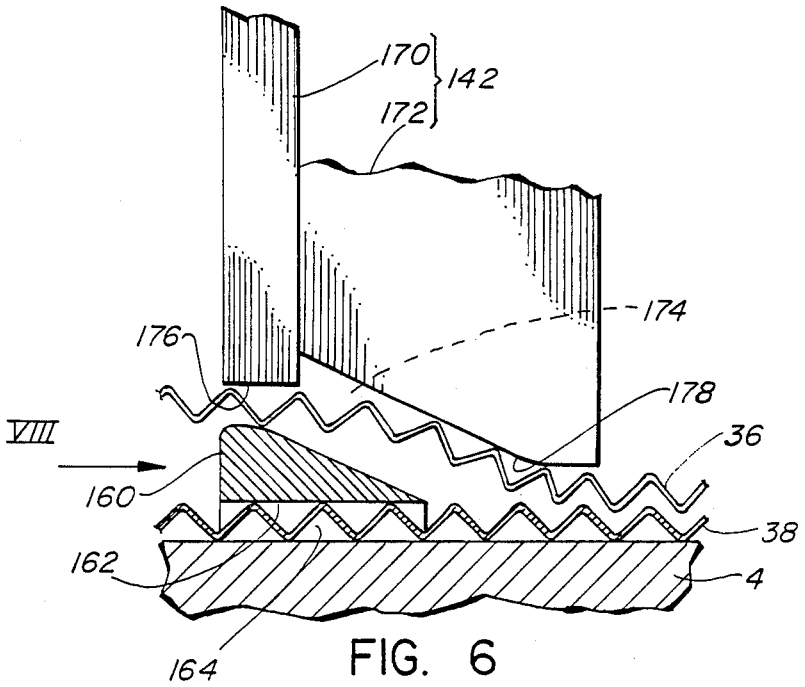
FIG. 6 is a view similar to FIG. 5, with the guide parts shown in different positions relative to one another.
Figure 7:
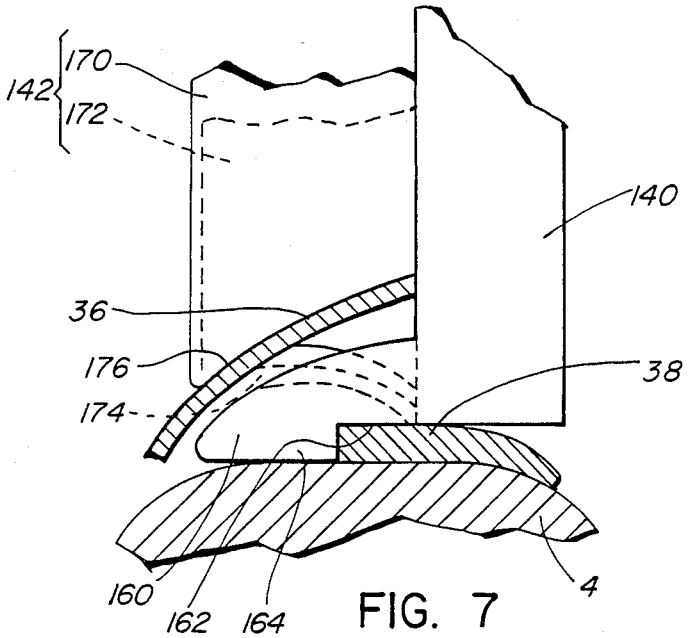
Figure 8:
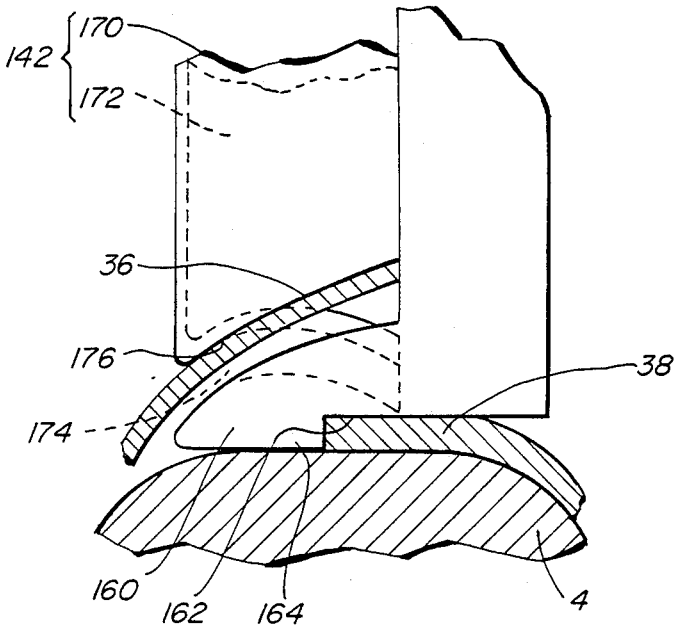

FIG. 7 a fragmentary front elevational view of the guide parts taken in the direction of arrow VII in FIG. 5; and FIG. 8 is a view similar to FIG. 7 taken in the direction of arrow VIII in FIG. 6.

Figure 1:
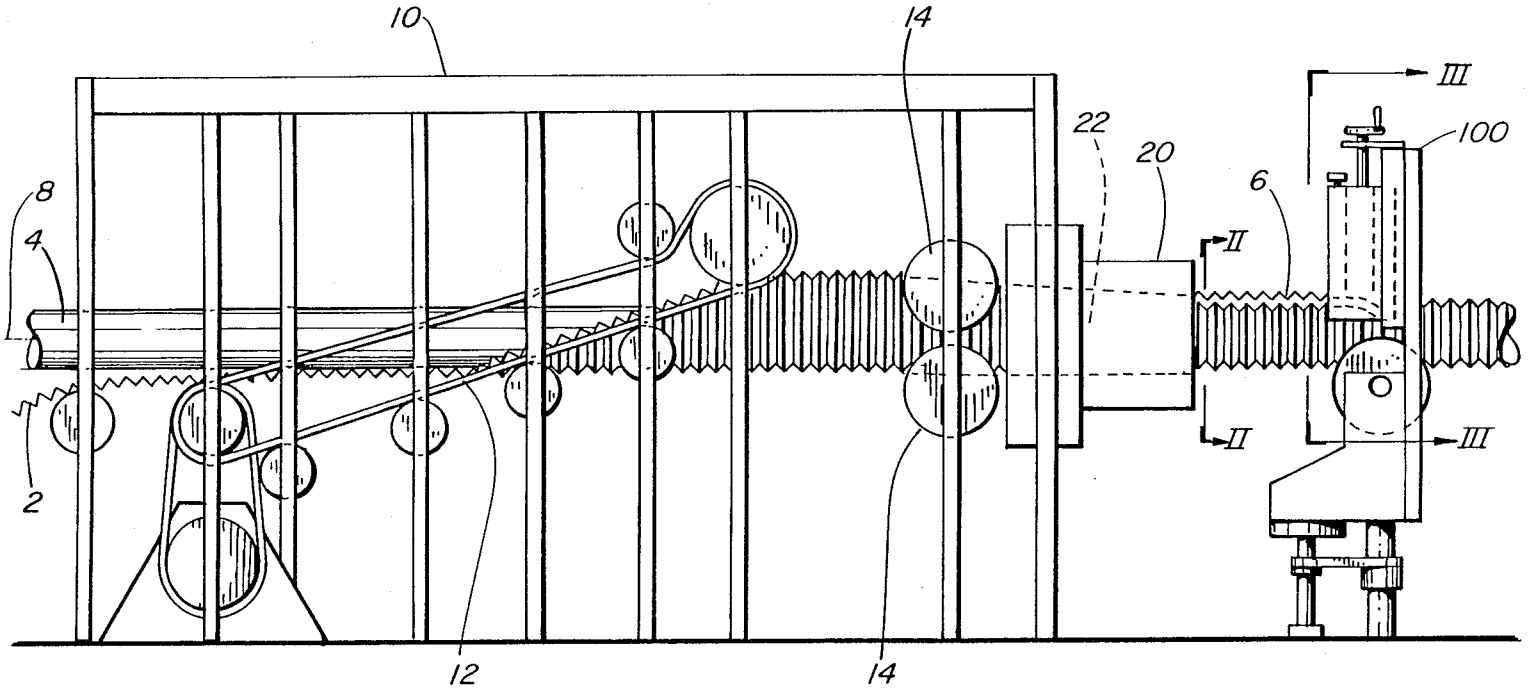

Apparatus for wrapping a metallic strip 2 around a cable core 4 to form a metallic shield 6 is shown in FIG. 1. The apparatus may be used with either corrugated or uncorrugated strip, and is shown as used with corrugated strip. The apparatus includes a conventional V-belt former 10, a conventional overlapping die 20, and apparatus 100 according to an embodiment of the invention for closing a metallic shield around a cable core.

The metallic strip 2 enters the V-belt former 10 as shown at the left of FIG. 1 and is brought alongside the cable core 4. The strip 2 and core 4 are advanced together along a passline 8 between V-belts 12 which are inclined upward and inward toward the passline at opposite sides of the passline. The V-belts 12 bend the strip 2 transverse to its longitudinal axis to wrap it upward partially around the cable core 4. The strip 2 and core 4 are then passed between contoured rollers 14 and through the overlapping die 20 having a tapered die passage 22 which further bends the strip 2 around the core 4 so that the strip provides a partially formed shield 6 around the core 4.

Figure 2:
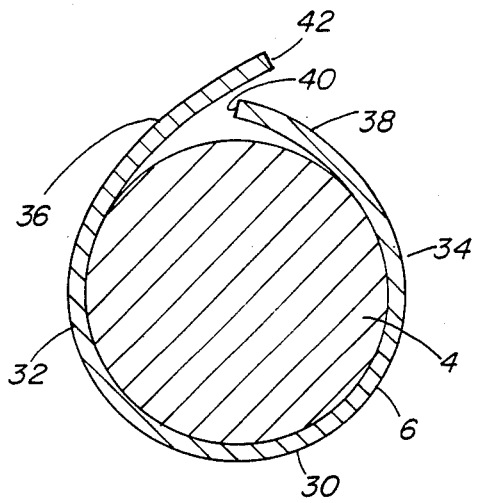

A cross-sectional view of the partially formed shield 6 and core 4 as they leave the overlapping die 20 and approach the shield closing apparatus 100 is shown in FIG. 2. The shield 6 is wrapped around the core 4 with a longitudinally extending central region 30 of the shield contacting the core, longitudinally extending regions 32, 34 of the shield flanking the central region 30 on opposite sides of the core 4, and longitudinally extending edge regions 36, 38 of the shield overlapping near the core opposite the central region. After leaving the overlapping die 20, the core 4 and shield 6 are passed together along the passline 8 through the shield closing apparatus 100 to close the shield 6 around the core 4, bringing the overlapping edge regions 36, 38 of the shield into firm contact with one another to form a seam.

Figure 4:
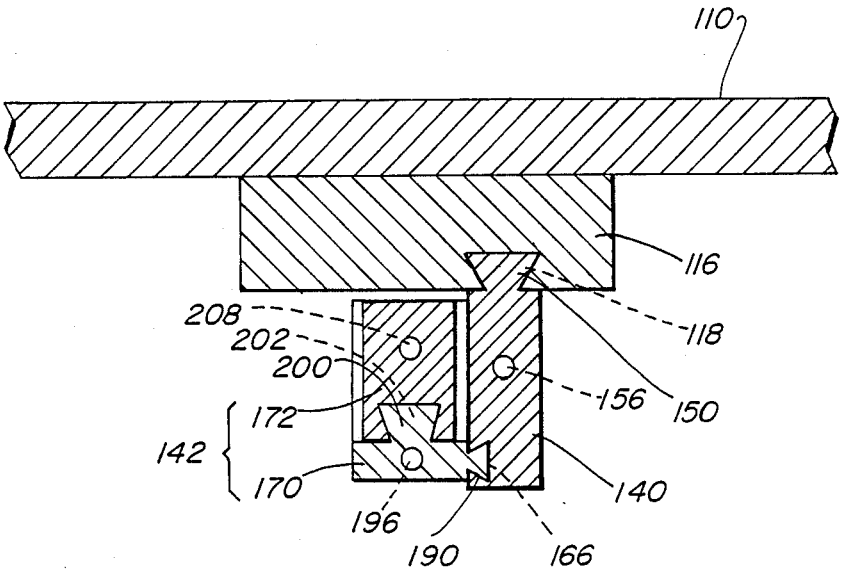
FIG. 4 is a fragmentary cross-sectional view of the apparatus of the embodiment taken along section line IV—IV in FIG. 3.
Figure 3:
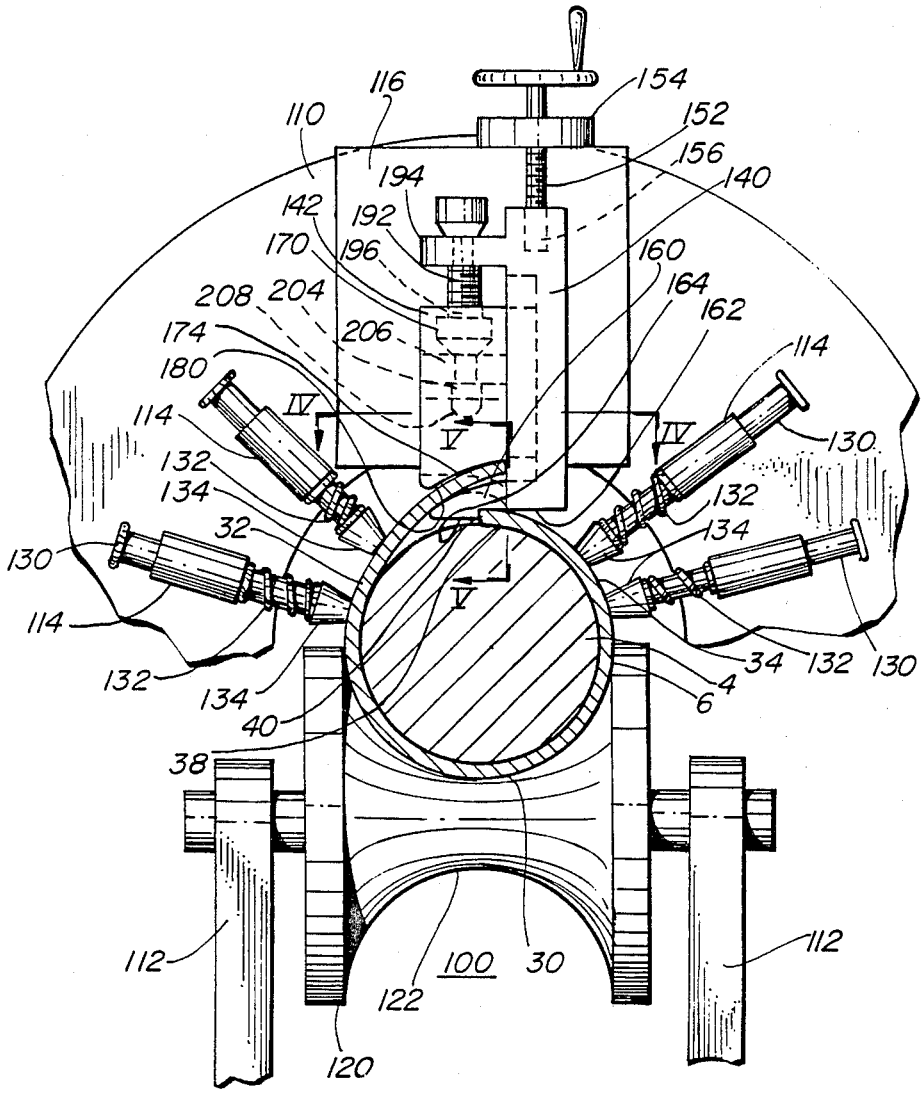
FIG. 3 is a fragmentary front elevational view, partly in cross-section, of the apparatus of the embodiment taken along section line III—III in FIG. 1 and drawn to the scale of FIG. 2.

A detailed view of the shield closing apparatus 100 is provided in FIG. 3. The apparatus 100 includes frame means comprising an arcuate frame member 110 extending over and partially around the passline 8, and a roller support bracket 112 disposed beneath the passline. The arcuate frame member 110 includes four fixtures 114 angularly spaced around the passline 8 in two pairs, one pair in each direction from the roller support bracket 112, and a metal block 116 disposed opposite the roller support bracket. As shown in FIG. 4, the metal block 116 includes a radially extending slot 118 of dovetail-shaped cross-section.

Support means comprising a roller 120 rotatably mounted to the bracket 112 and having a concave circumferential support surface 122 disposed to one side of the passline 8 is provided for engaging the central region 30 of the shield 6 to support the shield and core 4 on the passline.

Shield engaging members comprising four plungers 130 are radially slidably mounted, each in a respective one of the fixtures 114. Thus, the plungers 130 are arranged in pairs, one pair in each of two locations angularly spaced around the passline 8, one location in each direction from the support surface 122. Each plunger 130 is resliently urged radially inwards towards the passline 8 by resilient means comprising a helical compression spring 132 acting between the fixture 114 carrying the plunger and a head 134 of the plunger. The plungers 130 engage and urge the flanking regions 32, 34 of the shield 6 in a radially inwards direction towards the passline 8 and against the core 4.

Edge region guide means, comprising a first guide part 140 and a second guide part 142 carried by the first guide part, is radially movably mounted to the metal block 116 angularly between the two locations of the plungers 130. As shown in FIG. 4, the first guide part 140 includes dovetail-shaped projection 150 which is slidably received in the radial slot 118 of the metal block 116 to effect the radially movable mounting of the guide means. A threaded shaft 152, rotatably mounted in a collar 154 fixed to the metal block 116, and engaging a threaded bore 156 in the first guide part 140 provides screw adjustment means between the first guide part and the frame means whereby the position of the first guide part is continuously radially adjustable relative to the passline 8. This adjustment means is operable between the frame means and the guide means for radially moving the guide means to a radial position which is appropriate for the cable core 4 around which the shield 6 is to be closed.

As shown in FIG. 3, the first guide part 140 has a radially inner end which includes a foot 160 bearing a radially inner surface 162 which acts as a guide surface for engaging the radially inner edge region 38 of the shield 6 and guiding it onto the core 4 as the shield and core are advanced together along the passline 8. The foot 160 includes a radially inward projection 164 adjacent the radially inner guide surface 162 for engaging the edge 40 of the radially inner edge region 38 to prevent counterclockwise rotation of the shield 6 as it is advanced through the apparatus 100. As shown in FIG. 4, the first guide part 140 also includes a radially extending slot 166 of dovetail-shaped cross-section.

The second guide part 142, which comprises an upstream element 170 and a downstream element 172 carried on the upstream element, is mounted to the first guide part 140 radially outward of the foot 160 to define a channel 174 between the second guide part and the foot for receiving, guiding and forming the radially outer edge region 36 of the shield 6 in overlapping relationship onto the radially inner edge region 38 as the shield is advanced along the passline 8. The radially inner surfaces 176, 178 of the upstream and downstream elements 170, 172 define, respectively, upstream and downstream regions of a guide surface 180 overlying and converging toward the radially inner guide surface 162. It is this radially outer guide surface 180 which guides the radially outer edge region 36 of the shield 6 in overlapping relationship onto the radially inner edge region 28 as the shield is advanced along the passline 8. As shown in FIGS. 5 and 7, the radially outer guide surface 180 is curved progressively inward toward the passline 8 in successive planes in a downstream direction of, and extending transverse to the passline so as to curl the radially outer edge region 36 of the shield 6 inward as the shield is advanced along the passline. Curling of the radially outer edge region 36 prevents protrusion of the radially outer edge 42 into a cable jacket (not shown) subsequently extruded onto the shield 6. Such protrusion could cause the radially outer longitudinal edge 42 to cut through the jacket when the jacketed cable is bent, permitting ingress of water and other contaminants into the cable core 4.

As shown in FIG. 4, the upstream element 170 includes a dovetail-shaped projection 190 which is slidably received in the radially extending slot 166 of the first guide part 140 to provide radially movable mounting of the upstream element, and hence the second guide part 142, to the first guide part. Screw adjustment means comprising a threaded shaft 192, rotatably mounted in a collar 194 fixed to the first guide part 140 and engaging a threaded bore 196 in the upstream element 170 permits radial adjustment of the upstream element, and hence the second guide part 142, with respect to the first guide part 140. This adjustment means can be used to adjust the width of the channel 174 to accommodate different shield thicknesses and corrugation depths, and to widen the channel to facilitate initial feeding of the shield through the channel.

The upstream element 170 also includes a radially extending projection 200 of dovetail-shaped cross-section. The downstream element 172 includes a dovetail-shaped slot 202 which is slidably received on the projection 200 to provide radially movable mounting of the downstream element to the upstream element 170. Screw adjustment means comprising a threaded shaft 204 rotatably mounted in a collar 206 fixed to the upstream element 170 and engaging a threaded bore 208 in the downstream element 172 provides means for adjusting the relative radial positions of the upstream and downstream elements whereby the position of the downstream region 182 of the radially outer guide surface 184 is continuously adjustable relative to the position of the radially inner guide surface 162. As described below, this adjustment permits control of the extent to which the radially outer edge region 36 of the shield 6 is deformed inward toward the radially inner edge region 38.

In use of the apparatus 100, the threaded shafts 152, 192, 204 are rotated to move the first guide part 140 away from the passline 8, and the upstream and downstream elements 170, 172 away from the foot 160 so as to provide adequate clearance for easy feeding of the core 4 and shield 6 into the apparatus. The core 4 and shield 6 are then advanced along the passline 8 onto the roller 120 and between the two pairs of plungers 130, while feeding the radially inner edge region 38 of the shield between the foot 160 and the core, and the radially outer edge region 36 through the channel 174. The threaded shaft 152 mounted to the metal block 116 is rotated to move the entire guide means radially inward toward the passline 8, until the radially inner guide surface 162 engages the radially inner edge region 36 of the shield 6 and guides it onto the core 4. Note that the threaded shaft 152 provides means for moving the entire guide means to adjust the positions of the radially inner and outer guide surfaces 162, 184 to accommodate cable cores 4 of different diameters.

The threaded shaft 192 mounted to the first guide part 140 is then rotated to move the upstream and downstream elements 170, 172 radially inward until the upstream region 180 of the radially inner guide surface 184 is spaced from the foot 160 by a radial distance slightly greater than the corrugation depth of the shield 6. This adjustment controls the radial position of the radially outer edge region 36 of the shield 6 as it enters the channel 174.

The threaded shaft 204 mounted to the upstream element 170 is then rotated to move the downstream element 172 radially on the upstream element 170 until the radially outer edge region 36 of the shield 6 is formed radially inward firmly against the radially inner edge region 38 as the core 4 and shield 6 are advanced together through the apparatus 100. The effect of this adjustment is illustrated in FIGS. 5, 6, 7 and 8 which show two relative positions of the upstream and downstream elements 170, 172.

Note that shield closing apparatus having alternative mounting arrangements for the edge region guide means fall within the scope of the invention if the radial position of the guide means is adjustable relative to the passline. For example, in modifications not shown, either the upstream and downstream elements are separately radially adjustably mounted to the first guide part, or the upstream element, downstream element and first guide part are all separately radially adjustably mounted to the frame means. As a further alternative, and simple arrangement, a single guide part bearing both the radially inner and outer guide surfaces, fixed in position relative to one another but radially adjustable relative to the passline, could be provided, although this arrangement would lack many of the features advantageously provided by the embodiment described above.

What is claimed is:

1. Apparatus for closing a metallic shield around a cable core as the shield and core are advanced together along a passline through the apparatus, the shield and core approaching the apparatus with the shield wrapped around the core, a longitudinally extending central region of the shield contacting the core, longitudinal regions of the shield flanking the central region on opposite sides of the core, and longitudinally extending edge regions of the shield overlapping near the core opposite the central region, the apparatus comprising:

frame means;

support means carried by the frame means and having a support surface disposed to one side of the passline for engaging the central region of the shield to support the shield and core on the passline;

a plurality of shield engaging members carried by the frame means in two locations angularly spaced around the passline, one location in each direction from the support surface, the shield engaging members being resiliently urged radially inwards toward the passline to engage and urge the flanking regions of the shield in a radially inwards direction towards the passline;

edge region guide means for urging the edge regions of the shield in overlapping relationship onto the core, said guide means radially movably mounted to the frame angularly between the two locations of the shield engaging members, and having a radially inner guide surface extending in the direction of the passline for guiding one edge region onto the core to form a radially inner edge region, and a radially outer guide surface radially overlying and converging towards the radially inner guide surface for guiding the other edge region as a radially outer edge region in overlapping relationship onto said radially inner edge region; and adjustment means operable between the frame means and the guide means for radially moving the guide means to adjust the positions of the radially inner and outer guide surfaces.

2. Apparatus as defined in claim 1, wherein the guide means includes a radially inward projection adjacent the radially inner guide surface for engaging the edge of the radially inner edge region.

3. Apparatus for closing a metallic shield around a cable core as the shield and core are advanced together along a passline through the apparatus, the shield and core approaching the apparatus with the shield wrapped around the core, a longitudinally extending central region of the shield contacting the core, longitudinal regions of the shield flanking the central region on opposite sides of the core, and longitudinally extending edge regions of the shield overlapping near the core opposite the central region, the apparatus comprising:

frame means;

support means carried by the frame means and having a support surface disposed to one side of the passline for engaging the central region of the shield to support the shield and core on the passline;

a plurality of shield engaging members carried by the frame means in two locations angularly spaced around the passline, one location in each direction from the support surface, the shield engaging members being resiliently urged radially inwards toward the passline to engage and urge the flanking regions of the shield in a radially inwards direction towards the passline;

edge region guide means for urging the edge regions of the shield in overlapping relationship onto the core, said guide means radially movably mounted to the frame angularly between the two locations of the shield engaging members, and having a radially inner guide surface extending in the direction of the passline for guiding one edge region onto the core to form a radially inner edge region, and a radially outer guide surface radially overlaying and converging towards the radially inner guide surface for guiding the other edge region as a radially outer edge region in overlapping relationship onto said radially inner edge region; the radially outer guide surface being curved progressively inward toward the passline in successive planes in a downstream direction of, and extending transverse to the passline so as to curl the radially outer edge region of the shield inward as the shield is advanced along the passline; and adjustment means operable between the frame means and the guide means for radially moving the guide means to adjust the positions of the radially inner and outer guide surfaces.

4. Apparatus for closing a metallic shield around a cable core as the shield and core are advanced together along a passline through the apparatus, the shield and core approaching the apparatus with the shield wrapped around the core, a longitudinally extending central region of the shield contacting the core, longitudinal regions of the shield flanking the central region on opposite sides of the core, and longitudinally extending edge regions of the shield overlapping near the core opposite the central region, the apparatus comprising:

frame means;

support means comprising a roller rotatably mounted to the frame means and having a concave circumferential support surface;

disposed to one side of the passline for engaging the central region of the shield to support the shield and core on the passline;

a plurality of shield engaging members carried by the frame means in two locations angularly spaced around the passline, one location in each direction from the support surface, the shield engaging members being resiliently urged radially inward toward the passline to engage and urge the flanking regions of the shield in a radially inward direction towards the passline;

edge region guide means for urging the edge regions of the shield in overlapping relationship onto the core, said guide means radially movably mounted to the frame angularly between the two locations of the shield engaging members, and having a radially inner guide surface extending in the direction of the passline for guiding one edge region onto the core to form a radially inner edge region, and a radially outer guide surface radially overlying and converging towards the radially inner guide surface for guiding the other edge region as a radially outer edge region in overlapping relationship onto said radially inner edge region; and adjustment means operable between the frame means and the guide means for radially moving the guide means to adjust the positions of the radially inner and outer guide surfaces.

5. Apparatus for closing a metallic shield around a cable core as the shield and core are advanced together along a passline through the apparatus, the shield and core approaching the apparatus with the shield wrapped around the core, a longitudinally extending central region of the shield contacting the core, longitudinal regions of the shield flanking the central region on opposite sides of the core, and longitudinally extending edge regions of the shield overlapping near the core opposite the central region, the apparatus comprising:

frame means;

support means carried by the frame means and having a support surface disposed to one side of the passline for engaging the central region of the shield to support the shield and core on the passline;

a plurality of shield engaging members carried by the frame means in two locations angularly spaced around the passline, one location in each direction from the support surface, the shield engaging members comprising plungers radially slidably mounted to the frame means and urged radially inwards by resilient means acting between the frame means and the plungers;

to engage and urge the flanking regions of the shield in a radially inward direction towards the passline;

edge region guide means for urging the edge regions of the shield in overlapping relationship onto the core, said guide means radially movably mounted to the frame angularly between the two locations of the shield engaging members, and having a radially inner guide surface extending in the direction of the passline for guiding one edge region onto the core to form a radially inner edge region, and a radially outer guide surface radially overlying and converging towards the radially inner guide surface for guiding the other edge region as a radially outer edge region in overlapping relationship onto said radially inner edge region; and adjustment means operable between the frame means and the guide means for radially moving the guide means to adjust the positions of the radially inner and outer guide surfaces.

6. Apparatus for closing a metallic shield around a cable core as the shield and core are advanced together along a passline through the apparatus, the shield and core approaching the apparatus with the shield wrapped around the core, a longitudinally extending central region of the shield contacting the core, longitudinal regions of the shield flanking the central region on opposite sides of the core, and longitudinally extending edge regions of the shield overlapping near the core opposite the central region, the apparatus comprising:

frame means;

support means carried by the frame means and having a support surface disposed to one side of the passline for engaging the central region of the shield to support the shield and core on the passline;

a plurality of shield engaging members carried by the frame means in two locations angularly spaced around the passline, one location in each direction from the support surface, the shield engaging members being resiliently urged radially inwards toward the passline to engage and urge the flanking regions of the shield in a radially inwards direction towards the passline;

edge region guide means for urging the edge regions of the shield in overlapping relationship onto the core, said guide means comprising:

a first guide part radially adjustably mounted to the frame means angularly between the two locations of the shield engaging members, and having a radially inner end including a foot bearing a radially inner guide surface;

extending in the direction of the passline for guiding one edge region onto the core to form a radially inner edge region; and a second guide part bearing a radially outer guide surface radially overlying and converging towards the radially inner guide surface for guiding the other edge region as a radially outer edge region in overlapping relationship onto said radially inner edge region;

the second guide part being radially adjustably mounted to the first guide part radially outward of the foot to define a channel between the second guide part and the foot for receiving, guiding and forming the radially outer edge region in overlapping relationship onto the radially inner edge region as the shield is advanced; and adjustment means operable between the frame means and the guide means for radially moving the guide means to adjust the positions of the radially inner and outer guide surfaces.

7. Appratus as defined in claim 6, wherein the radially outer guide surface is curved progressively inward toward the passline in successive planes in a downstream direction of, and extending transverse to the passline so as to curl the radially outer edge region of the shield inward as the shield is advanced along the passline.

8. Apparatus as defined in claim 6, wherein the guide means includes a radially inward projection adjacent the radially inner guide surface for engaging the edge of the radially inner edge region.

9. Apparatus as defined in claim 6, wherein the support means comprises a roller rotatably mounted to the frame means and having a concave circumferential support surface.

10. Apparatus as defined in claim 6, wherein the shield engaging members comprise plungers radially slidably mounted to the frame means and urged radially inwards by resilient means acting between the frame means and the plungers.

11. Apparatus as defined in claim 6, wherein the second guide part comprises an upstream element and a downstream element defining, respectively, an upstream region and a downstream region of the radially outer guide surface, and means for adjusting the relative radial positions of the upstream and downstream elements.

12. Apparatus as defined in claim 11, wherein the radially outer guide surface is curved progressively inward toward the passline in successive planes in a downstream direction of, and extending transverse to the passline so as to curl the radially outer edge region of the shield inward as the shield is advanced along the passline.

13. Apparatus as defined in claim 11, wherein the guide means includes a radially inward projection adjacent the radially inner guide surface for engaging the edge of the radially inner edge region.

14. Apparatus as defined in claim 11, wherein the support means comprises a roller rotatably mounted to the frame means and having a concave circumferential support surface.

15. Apparatus as defined in claim 11, wherein the shield engaging members comprise plungers radially slidably mounted to the frame means and urged radially inwards by resilient means acting between the frame means and the plungers.

16. Apparatus as defined in claim 11, wherein the upstream element is radially adjustably mounted upon the first guide part and the downstream element is radially adjustably mounted upon the upstream part.

17. Apparatus as defined in claim 16, wherein the radially outer guide surface is curved progressively inward toward the passline in successive planes in a downstream direction of, and extending transverse to the passline so as to curl the radially outer edge region of the shield inward as the shield is advanced along the passline.

18. Apparatus as defined in claim 16, wherein the guide means includes a radially inward projection adjacent the radially inner guide surface for engaging the edge of the radially inner edge region.

19. Apparatus as defined in claim 16, wherein the support means comprises a roller rotatably mounted to the frame means and having a concave circumferential support surface.

20. Apparatus as defined in claim 16, wherein the shield engaging members comprise plungers radially slidably mounted to the frame means and urged radially inwards by resilient means acting between the frame means and the plungers.

21. Apparatus as defined in claim 16, provided with a screw adjustment means between the downstream and upstream elements, whereby the position of the downstream region of the radially outer guide surface is continuously radially adjustable relative to the position of the radially inner guide surface.

22. Apparatus as defined in claim 21, wherein the adjusting means comprises another screw adjustment means between the first guide part and the frame means, whereby the position of the first guide part is continuously radially adjustable relative to the passline.

* * * * *